US005577467A

United States Patent [19]

Bormann

[11] Patent Number: 5,577,467

[45] Date of Patent: Nov. 26, 1996

[54] HEATING METHOD AND HEATING DEVICE

[75] Inventor: Wilhelm Bormann, Freiburg, Germany

[73] Assignee: Fides Gesellschaft für Finanzplanung mbH, Timmendorfer Strand, Germany

[21] Appl. No.: 170,704

[22] Filed: Dec. 21, 1993

[30] Foreign Application Priority Data

May 18, 1993 [DE] Germany ..... 43 16 615.6
Jun. 9, 1993 [DE] Germany ..... 43 19 176.2

[51] Int. Cl.[6] ..... F22B 1/02; F24C 9/00

[52] U.S. Cl. ..... 122/27; 126/247

[58] Field of Search ..... 122/26, 27; 126/247; 237/1 R

[56] References Cited

U.S. PATENT DOCUMENTS 4,176,969 12/1979 Wallace et al. .
4,239,679 12/1980 Rolls et al. .
4,781,151 11/1988 Wolpert, Jr. et al. ..... 122/26

FOREIGN PATENT DOCUMENTS 0211414 2/1989 European Pat. Off. .
3500821 7/1986 Germany ..... 122/2 P

*Primary Examiner*—Henry A. Bennett
*Assistant Examiner*—Susanne C. Tinker
*Attorney, Agent, or Firm*—Friedrich Kueffner

[57] ABSTRACT

The heating method, more particularly for dwellings, in which a pulverulent or granular mixture comprising a plastic and a stabilizing agent, which is vortexed with air in a dry mixer, in which the outer wall of the dry mixer, for the dissipation of heat, is circumcirculated with water circulating in a heating circulation system, consists in that, as a stabilizing agent for the small plastic particles, a mercaptide is used and/or in that the vortexing is performed in a reposingly disposed container extending via a vortexing path over a horizontal area; which is carried out in a device comprised of a double-walled container (10) with a vortexing means of a wing mixer (20), while water is circulated as a part of a heating circulation system in the interspace of the double wall (11, 12), and in that the preferably cylindrical container is disposded so as to be reposing and is provided with a wing mixer (20) capable of rotating about a horizontal shaft (FIG. 1).

29 Claims, 2 Drawing Sheets

HEATING METHOD AND HEATING DEVICE

BACKGROUND OF THE INVENTION

The present invention relates to a heating method, more particularly for dwellings, in which a pulvurelent or granular mixture comprising a plastic and a stabilizing agent is employed, which is vortexed with air in a dry mixer, while the outer wall of the mixer is circumcirculated with water which circulates in a heating circulation system for the dissipation of heat, and a device for performing this method, comprising a double-walled container with a vortexing means disposed in the container interior, in which, in the interspace between the double walls, water is circulated as part of a heating circulation system.

The method known from the DE-A-35 00 821 is based upon the circumstance that PVC granulate or powder is heated during the mixing which can be collected on the cooling jacket of a mixer. In order to achieve a relatively low temperature difference between the actual heat producer—the mixer—and the heat consumer, it is proposed to admix a stanniferous substance to the PVC-containing material and to vortex this mixture over a period of several days to several weeks and to collect or tap the heat being produced, in this case by virtue of the mixture composition. Depending on the speed of the agitator or mixer used for the vortexing, a more or a less intense heat can be produced. As heat producer, an essentially cylindrical container having an inner cylindrical space which is surrounded by a jacket is used, around which a second jacket is disposed at a distance so that it is possible for water to be circulated in the space located therebetween. Mixing blades or paddles are disposed on the bottom of the cylindrical container, whose axis is driven direct by a motor. However, in this connection it has been shown that an emission of heat takes place only within the vortexing region at the bottom by the charged material and consequently solely a small wall area with a cooling jacket was available for collecting the heat obtained and for being able to employ the same for heating purposes. To this is added the circumstance that the charged quantity of material could not be a large one since a vortexing of the material takes place only within the bottom region of the cylindrical mixer used in which the mixing means is disposed.

It is the technical problem of the present invention to improve the stated method and device to the effect that the efficiency is increased and the application time of the plastic granulate per employed charge is extended and that it is possible also for other plastics to be made use of.

SUMMARY OF THE INVENTION

This technical problem is resolved by the method described in the claims 1 and 2, according to which a mercaptide is employed as stabilizing agent and/or the vortexing is effecetd in a reposing container. In contrast to the stanniferous composition stated in the DE-A-35 00 821 C2, the mercaptide possesses a better capability of giving off the heat produced during the agitation or vortexing to the container jacket. As a further alternative or as an additional step it is proposed to dispose the container not so as to stand upright, but so as to repose, whereby it is possible to minimize the energy which is required for a one hundred per cent vortexing of the small plastic particles present in the container. In addition, by means of the wing mixer disposed in the mixing container and extending across the entire interior of the mixing container, a vortexing of the base material in the entire container chamber takes place so that the produced heat is given off uniformly to the entire container wall area constructed in the form of a cooling jacket and collected. Consequently, the cooling jacket area is altogether larger and the efficiency is thus improved.

By preference, an octyl-tin mercaptide is used as a mercaptide.

According to a further embodiment of the invention, the vortexing is carried out in a reposingly disposed cylindrical container, in which a wing agitator or mixer rotates relative to the inner walk of said cylindrical container. A cylindrical container affords the advantage that no niches are able to form in which only a poor vortexing takes place and the thorough mixing can be performed homogeneously over the entire cross-section. The wing mixer is preferably operated at a rotational speed of from 1,450 to 2,900 rpm.

Apart from the circumstance that it is possible to perform the method according to the invention without any exhaust air being produced, it is possible to also achieve a further saving in that e.g. PVC-containing material from waste or scrap material in the form of used bottles or the like is employed. Expediently, due to the dissipation of heat, the temperature of the vortexed material is limited to a level not exceeding 160° C. However, a limiting temperature ranging from approximately 150° C. to 160° C. is preferred. It is possible hereby to avoid heat losses. Furthermore, the cylindrical chamber for the vortexing has to be selected in such a way that the ratio of the diameter in relation to the length is approximately 5:8 to approximately 5:10 with a charge that takes up approximately 40% to 60% of the height.

The selection of the stabilizing agent makes it possible to also employ plastics other than exclusively PVC as base material so that the method also renders possible the utilization of other plastics. For it has surprisingly been shown that only by employing an octyl-tin mercaptide it is also possible to make use of other plastics, such as e.g. polyvinyl acetates, polypropylenes, in which connection it is expediently of advantage when e.g. a proportion of up to 80% by weight related to the different plastics is added.

The technical problem related to the device is resolved by the device described in the claims 10 and 11, in which the preferably cylindrical container, according to the invention, is disposed so as to be reposing and is provided with a wing mixer extending over the entire container length and taking up the entire interior of the container. With this it is possible to utilize the container interior over its entire cross-section for the vortexing and not merely 90% as in the upright container according to the DE-A-35 00 821.

Further embodiments of the wing mixer are described in the subclaims. The wing mixer is thus preferably mounted on a horizontally arranged, motor-driven shaft, from which several arms project sticking out from the shaft and provided with flow control plates at their ends. These flow control plates are inclined with respect to the arms at or 30° or $60^{\circ +}/+/-15^{\circ}$. This inclination brings about a shovel-like conveying and intermixing of the contents.

According to a further embodiment of the invention, each of the flow control plates extends substantially over the entire interior length of the container and is retained by means of several, preferably three, consecutively disposed arms which stick out radially from the shaft. Hereby the flow control blade receives the greatest possible stabilization with a maximized effectivity over the entire length of the container interior. It has proved itself when at least three, preferably four, flow control plates are provided, each at an identical angular distance of 120° or 90° respectively.

BRIEF DESCRIPTION OF THE DRAWINGS

An embodiment of the invention is depicted in the drawings. Thus

DETAILED DESCRIPTION OF THE PREFERRED EMBODIMENT

Figure 1:
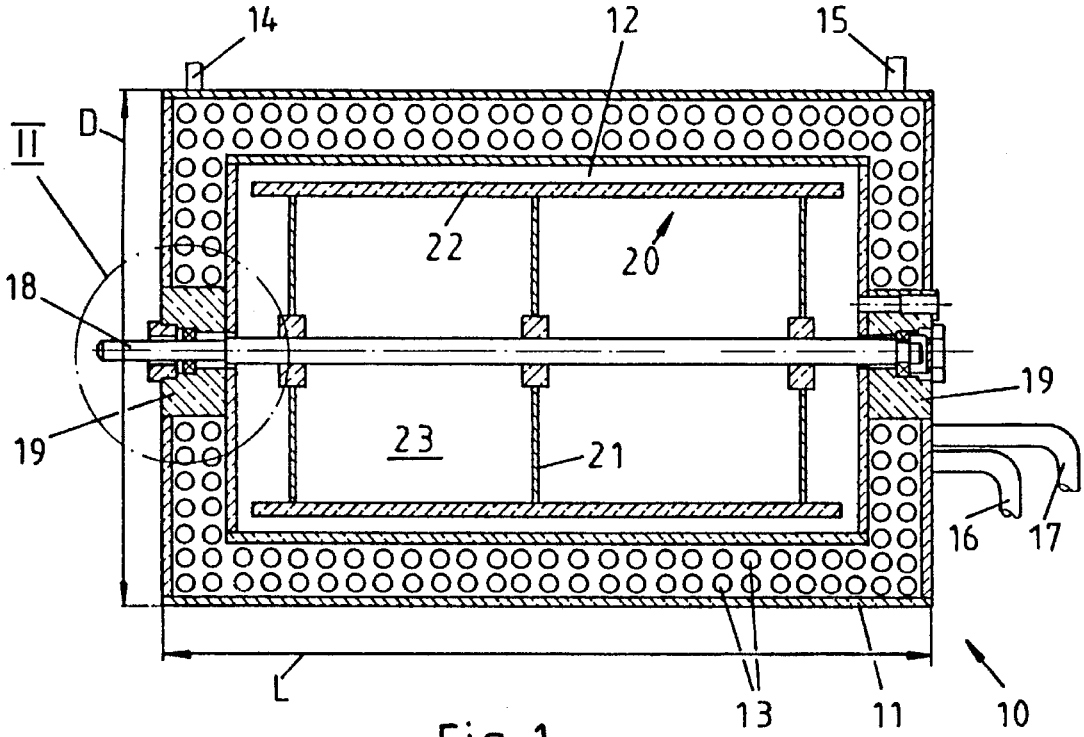
FIG. 1 shows a cross-sectional view of a device according to the invention.
Figure 2:
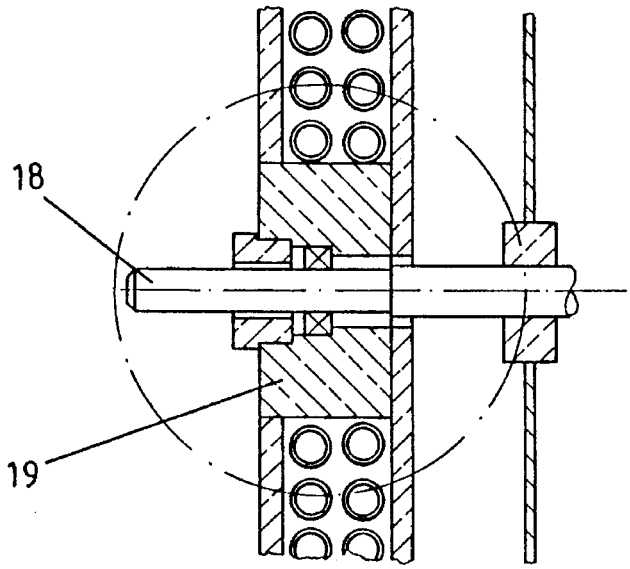
FIG. 2 shows a detail of a detail view II in FIG. 1.
Figure 4:
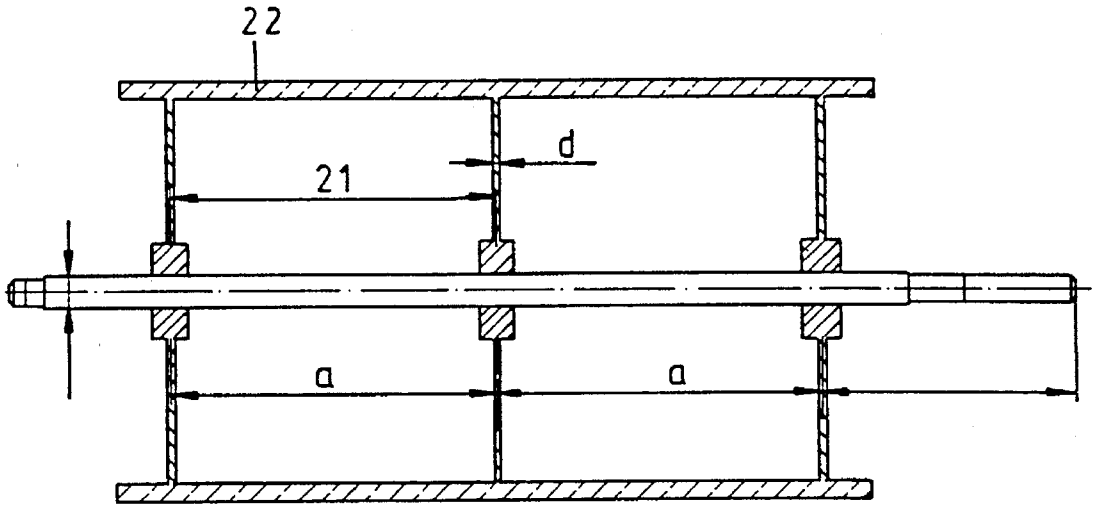
FIG. 4 shows a side view of the wing mixer.
Figure 3:
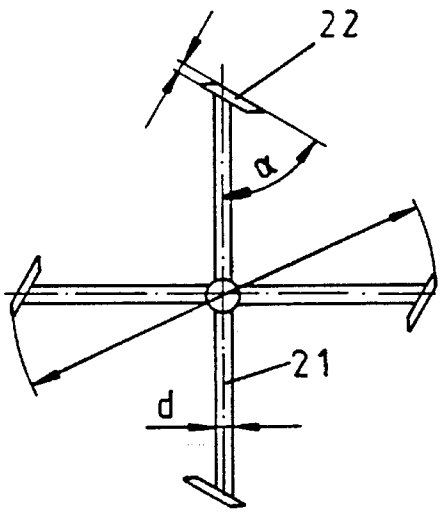
FIG. 3 shows a front view of the wing mixer.

The heat producer shown in FIG. 1 comprises a double-walled cylindrical container 10 which, between its outer jacket 11 and its inner jacket 12, possesses an interspace in which respective spiral pipes 13 for water for general use and/or heating water are disposed. The heating water inlet is identified with 14 and the outlet with 15, while the service water inlet bears the reference number 16 and the heating water outlet the reference number 17. The outer jacket 11 of the cylinder expediently possesses a length l of 60 cm, while the inner jacket has a length of that is shorter by 10 cm. Both containers are fabricated from copper sheet. The container 10, within the region of its longitudinal axis, is passed through by a shaft 18 which, on the one side, is connected to a non-depicted motor and is supported in bearing bushes 19. The shaft 18 serves as carrier of a wing mixer 20 which extends substantially across the entire length of the interior. This wing mixer 20 has arms 21 mounted on the shaft which (FIG. 3) are disposed in a crosswise fashion. Each of these arms bears a flow guide plate 22 on its outer end, i.e. in the case according to FIG. 3, four flow guide plates which extend over the entire length of the interior and of which each is retained by means of three arms 21. The flow guide plates 22 are inclined at an angle alpha=30° to the axis of an arm. The arm has a thickness d of approximately 0.5 cm. The reciprocal distances are approximately 20 cm.

The container interior 23 is half-filled with the mixture of a plastic powder or granulate, e.g. a PVC powder or granulate with a stabilizing agent of octyl-tin mercaptide. By virtue of the horizontally disposed reposing container 10, a high degree of efficiency and a significant gain in energy is obtained. By the vortexing of the filling when the shaft 18 is rotated, the plastic molecules are charged; the heat produced by the static charging is given off to the inner jacket 12, from where it is conducted to the water in the pipes 13. A one hundred percent utilization of the PVC granulate in heat is achieved. It is particularly advantageous that, due to the use of said stabilizing agent, the PVC granulate does not become exhausted and degradative reactions or agglomerations of the PVC particles, more particularly owing to the mercaptide employed are avoided, which wraps itself around the small particles of the PVC granulate in the form of a protective cover and thus stabilizes the PVC granulate for a longer service life. With the method according to the invention and the illustrated device, a smaller amount of energy is required than in the method described in the DE-A-35 00 821 C2. The method is environment-friendly and economical, more particularly no exhaust gases are produced as are in the combustion of fossile substances.

In lieu of the PVC granulate it is also possible for a powder or granulate of some other suitable plastic to be employed, thus inter alia also polymers.

The wall of the container 10 is comprised of plastic, expediently of PVC or some other thermally conductive material, such as steel plate which is coated with a plastic, expediently with PVC, on the inner wall. By the interaction of the plastic proportions of the charged mixture with the container wall comprised of a plastic, the heat production is substantially improved. Surprising results are achieved when a mercaptide, more particularly an octyl-tin mercatide is incorporated into the plastic which is given off in a retarded fashion over a prolonged period of time to the mixture present in the container during the votexing operation.

What is claimed is:

1. A heating method comprising vortexing with air in a dry mixer one of a pulverulent mixture and a granular mixture comprising a plastic including small plastic particles and a stabilizing agent, conducting water which circulates in a heat circulation system through an interspace of a double wall of a container of the dry mixer for dissipation of heat, further comprising utilizing mercaptide as a stabilizing agent for the small plastic particles, carrying out vortexing in a horizontally extending container via a vortexing path extending over a horizontal area and effecting vortexing by utilizing a wing mixer rotating about a horizontal shaft.

2. The heating method according to claim 1, wherein the small plastic particles are small PVC particles.

3. The heating method according to claim 1, wherein the container has an interior, comprising carrying out vortexing over a horizontal area in the entire interior of the container.

4. The heating method according to claim 1, wherein vortexing is carried out in a reposing cylindrical container having an interior and a container wall, comprising rotating a wing mixer extending over the entire container interior in relation to the container wall.

5. The heating method according to claim 4, comprising rotating the wing mixer at a speed of 1,450 to 2,900 rpm.

6. The heating method according to claim 1, comprising utilizing waste or scrap material as the plastic material.

7. The heating method according to claim 1, comprising utilizing bottles as the plastic material.

8. The heating method according to claim 1, comprising admixing a proportion of PVC-containing material of up to 80% by weight to different plastic materials.

9. The heating method according to claim 1, comprising limiting the temperature of the vortexed material to a level not exceeding 160° C.

10. The heating method according to claim 1, comprising adjusting the temperature of the vortexed material to a range of from 150° C. to 160° C.

11. The heating method according to claim 1, comprising carrying out the vortexing in a cylindrical container having a diameter, a length and a height, wherein the ratio of diameter to length is approximately 5:8 to 5:9 and wherein the container is filled up with material up to approximately 4/10 to 6/10 of the container height.

12. A device for carrying out a heating method utilizing one of a pulverulent mixture and a granular mixture of a plastic and a stabilizing agent, the device comprising a double-walled cylindrical container having an axis and an interior, a vortexing means of a wing mixer being disposed in the container interior, water being circulated as part of a heating circulation system in an interspace of the double wall, the cylindrical container being disposed such that the axis of the container extends horizontally, the wing mixer being mounted so as to be rotating about a horizontal shaft.

13. The device according to claim 12, wherein the cylindrical container has a length, the wing mixer extending over the entire length and over the entire interior of the container.

14. The device according to claim 12, comprising a motor for driving the horizontal shaft.

15. The device according to claim 12, wherein the wing mixer comprises a plurality of arms extending radially from the horizontal shaft, the arms having ends, flow control plates being mounted on the ends.

16. The device according to claim 15, wherein the flow control plates are inclined at 30° to 60°±15° relative to the arms.

17. The device according to claim 15, wherein each of the flow control plates extends substantially over the entire length of the interior of the container, each flow control plate being retained by three arms attached consecutively to the horizontal shaft.

18. The device according to claim 15, comprising three flow control plates.

19. The device according to claim 15, comprising four control plates.

20. The device according to claim 12, wherein the container is comprised of plastic material.

21. The device according to claim 20, wherein the container is comprised of PVC material.

22. The device according to claim 12, wherein the container is comprised of thermally conductive material, and wherein the container is provided with an inner wall coating of a plastic material.

23. The device according to claim 22, wherein the thermally conductive material is steel sheet.

24. The device according to claim 22, wherein the plastic material is PVC.

25. The device according to claim 12, wherein the container comprises one of a wall and an inner wall coating of a plastic with an incorporated mercaptide.

26. The device according to claim 25, wherein the mercaptide is an octyl-tin mercaptide.

27. The device according to claim 12, wherein the container comprises one of a wall and an inner wall coating of a mixture of a plastic material and of a mercaptide.

28. The device according to claim 27, wherein the plastic material is PVC.

29. The device according to claim 27, wherein the mercaptide is an octyl-tin mercaptide.

* * * * *